US009806444B1

(12) United States Patent
Ju

(10) Patent No.: US 9,806,444 B1
(45) Date of Patent: Oct. 31, 2017

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/434,538

(22) Filed: Feb. 16, 2017

(30) Foreign Application Priority Data

Nov. 18, 2016 (CN) ..... 2016 2 1237863 U

(51) Int. Cl.
*H01R 12/00* (2006.01)
*H01R 12/58* (2011.01)
*H01R 13/24* (2006.01)

(52) U.S. Cl.
CPC ..... *H01R 12/585* (2013.01); *H01R 13/2442* (2013.01)

(58) Field of Classification Search
CPC ..... H01R 12/57
USPC ..... 439/83, 876
See application file for complete search history.

(56) References Cited

U.S. PATENT DOCUMENTS 7,377,792 B2 * 5/2008 Ma ..... H01R 13/41 439/71
7,682,165 B2 * 3/2010 Liao ..... H05K 3/3426 439/342
7,791,443 B1 * 9/2010 Ju ..... H01R 12/52 336/107
7,828,562 B2 * 11/2010 Wu ..... H01R 13/11 439/83
7,922,548 B2 * 4/2011 Fan ..... H01R 12/57 439/66
8,052,436 B1 * 11/2011 Ju ..... H01R 12/57 439/342
8,052,454 B2 * 11/2011 Polnyi ..... H01R 12/57 439/342
8,192,206 B1 * 6/2012 Ju ..... H01R 12/57 439/66
8,202,101 B2 * 6/2012 Zimmerman ..... H01R 4/02 439/70
8,235,734 B2 * 8/2012 Ju ..... H01R 12/57 439/83

(Continued)

FOREIGN PATENT DOCUMENTS

CN 203056199 U 7/2013

*Primary Examiner* — Neil Abrams
(74) *Attorney, Agent, or Firm* — Locke Lord LLP; Tim Tingkang Xia, Esq.

(57) ABSTRACT

An electrical connector includes an insulating body having a bottom plate with receiving slots and multiple terminals received in the receiving slots. Each receiving slot has two opposite first side walls, and a second and third side walls connecting the first side walls. A protruding block protrudes from the second side wall toward the third side wall. Each terminal has a plate portion, an elastic arm and a material connecting portion extending upward from the plate portion, a contact portion at a top end of the elastic arm to urge a chip module, and two clamping portions bending and extending from two opposite sides of the plate portion horizontally. The plate portion and the material connecting portion are limited between the protruding block and the third side wall. Tin balls are fixed between the clamping portions, and soldered to a circuit board. The tin balls are below the protruding block.

10 Claims, 6 Drawing Sheets

(56) References Cited

U.S. PATENT DOCUMENTS

| | | | | |
|---|---|---|---|---|
| 8,277,230 | B2 * | 10/2012 | Huo | H01R 12/716<br>439/342 |
| 8,491,337 | B2 * | 7/2013 | Cai | H01R 12/57<br>439/607.28 |
| 8,647,153 | B2 * | 2/2014 | Ju | H01R 12/714<br>439/626 |
| 8,708,716 | B1 * | 4/2014 | Ho | H01R 12/57<br>439/83 |
| 8,851,904 | B2 * | 10/2014 | Chang | H01R 12/71<br>439/607.03 |
| 8,858,241 | B2 * | 10/2014 | Cheng | B23K 1/0016<br>439/83 |
| 9,203,169 | B1 * | 12/2015 | Ju | H01R 12/7076 |
| 9,450,313 | B2 * | 9/2016 | Tsai | H01R 4/027 |
| 9,604,300 | B2 * | 3/2017 | Ju | B23K 1/0056 |

* cited by examiner

ELECTRICAL CONNECTOR

CROSS-REFERENCE TO RELATED APPLICATIONS

This non-provisional application claims priority to and benefit of, under 35 U.S.C. §119(a), Patent Application No. 201621237863.1 filed in P.R. China on Nov. 18, 2016, the entire content of which is hereby incorporated by reference.

FIELD OF THE INVENTION

The present invention relates to an electrical connector, and more particularly to an electrical connector for electrically connecting a chip module to a circuit board.

BACKGROUND OF THE INVENTION

Chinese Patent Application No. CN201220644972.0 discloses an electrical connector for electrically connecting a chip module to a circuit board. The electrical connector includes an insulating body having multiple receiving slots and multiple terminals received in the receiving slots. The terminals conduct the chip module and are soldered to the circuit board. A stopping block is disposed in each of the receiving slots. Each of the terminals has a flat plate portion. One side of the plate portion extends to form a material connecting portion. The material connecting portion is stopped between the stopping block and one inner wall of the receiving slot, so that the terminal is fixed at the receiving slot. A C-shaped bending arm is formed by bending and extending the lower part of each of the flat plate portions. The bending arm is stopped above a tin ball. A clamping portion is formed by extending the two sides of each of the bending arms. The clamping portion clamps the tin ball. The tin ball is soldered to the circuit board.

The foregoing electrical connector provides a structure of fixing the tin balls by using the terminals, but in the actual production process, the material connecting portion at one side of each of the terminals is retained between the stopping block and the inner wall of each of the receiving slots, so that the overall retaining force of the terminals is uneven, and thus the terminals are easily turned over when being assembled to the receiving slots from top to bottom, and the production yield of the electrical connector is reduced. In addition, the extending arm of each of the terminals is bent into a C-shaped structure to limit the upward location of the tin ball, thereby increasing the stamping molding difficulty of the terminals, and increasing the production cost of the electrical connector.

Therefore, a heretofore unaddressed need exists in the art to address the aforementioned deficiencies and inadequacies.

SUMMARY OF THE INVENTION

In one aspect, the present invention relates to an electrical connector that enables terminals to be stably retained and has low stamping molding difficulty.

In certain embodiments an electrical connector is used for conducting a chip module to a circuit board, and includes an insulating body, multiple terminals and multiple tin balls. The insulating body has a bottom plate, and multiple receiving slots are disposed in the bottom plate. Each of the receiving slots has two opposite first side walls, and a second side wall and a third side wall which are connected with the two first side walls and are opposite to each other. A protruding block protrudes from the second side wall toward the third side wall, and is separated from the two first side walls and the third side wall. The terminals are correspondingly accommodated in the receiving slots. Each of the terminals has a flat plate portion. An elastic arm and a material connecting portion are formed by extending upward from the flat plate portion. A contact portion is formed at the top end of the elastic arm to upward and elastically urge the chip module. Two clamping portions are formed by bending and extending from the two opposite sides of the flat plate portion along a horizontal direction. The flat plate portion and the material connecting portion are limited between the protruding block and the third side wall. The tin balls are respectively and correspondingly fixed between the two clamping portions, soldered to the circuit board, and positioned below the protruding block to be prevented from moving up.

In certain embodiments, the protruding block extends upward to be beyond the upper surface of the insulating body, and is used for supporting the chip module.

In certain embodiments, a supporting portion is disposed at the side edge of the bottom plate to support the chip module, and the top surface of the supporting portion is higher than the top surfaces of the protruding blocks.

In certain embodiments, two supporting blocks protruding upward from the two first side walls are positioned at the two opposite sides of the protruding block, and are used for supporting the chip module.

In certain embodiments, the two adjacent rows of terminals are disposed in a staggered way, and the elastic arms of the rear row of terminals extend beyond a part over the material connecting portions of the front row of terminals.

In certain embodiments, a stopping block protrudes from the bottom end of each of the receiving slots, a groove is concavely disposed at one side of the stopping block to limit a tin ball, and the other opposite side of the stopping block stops the two clamping portions of the corresponding terminal.

In certain embodiments, the flat plate portion includes a fixing portion for connecting the elastic arm and the material connecting portion. A connecting portion is formed by extending downward from the fixing portion. An extending portion is formed by extending downward from the connecting portion. The clamping portions are formed by extending from the two opposite sides of the extending portion. The width of the fixing portion, the width of the connecting portion and the width of the extending portion decrease sequentially.

In certain embodiments, the receiving slot is provided with a stopping surface. Two stopping portions are formed by extending upward from the tail ends of the two clamping portions and bending in an opposite direction, and are stopped at the stopping surface. The height of the top end of the stopping portion is between the upper edge and the lower edge of the connecting portion.

In certain embodiments, the stopping surface is higher than the bottom surface of the protruding block.

In certain embodiments, the elastic arm includes a first arm which is formed by bending from the top end of the flat plate portion and extending to a direction away from a vertical plane where the flat plate portion is positioned, and a second arm which returns, bends and extends from the first arm to be beyond the vertical plane where the flat plate portion is positioned. The first arm and the clamping portion are positioned at the two opposite sides of the vertical plane where the flat plate portion is positioned, and the second arm is connected with the contact portion.

Compared with the related art, certain embodiments of the present invention have the following beneficial advantages.

The flat plate portion and the material connecting portion are limited between the protruding block and the third side wall, so that the limiting forces of the terminals are even, and thus the turnover is avoided in assembly, the assembly difficulty of products is reduced, and the yield of the products is improved. Further, the tin ball is positioned below the protruding block so as to limit the upward movement of the tin ball, so that the arrangement that a C-shaped bending arm formed by bending the flat plate portion stops the tin ball is omitted, the terminal structure is simplified, the assembly difficulty of the electrical connector is reduced, and the market competitiveness of the products is improved.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
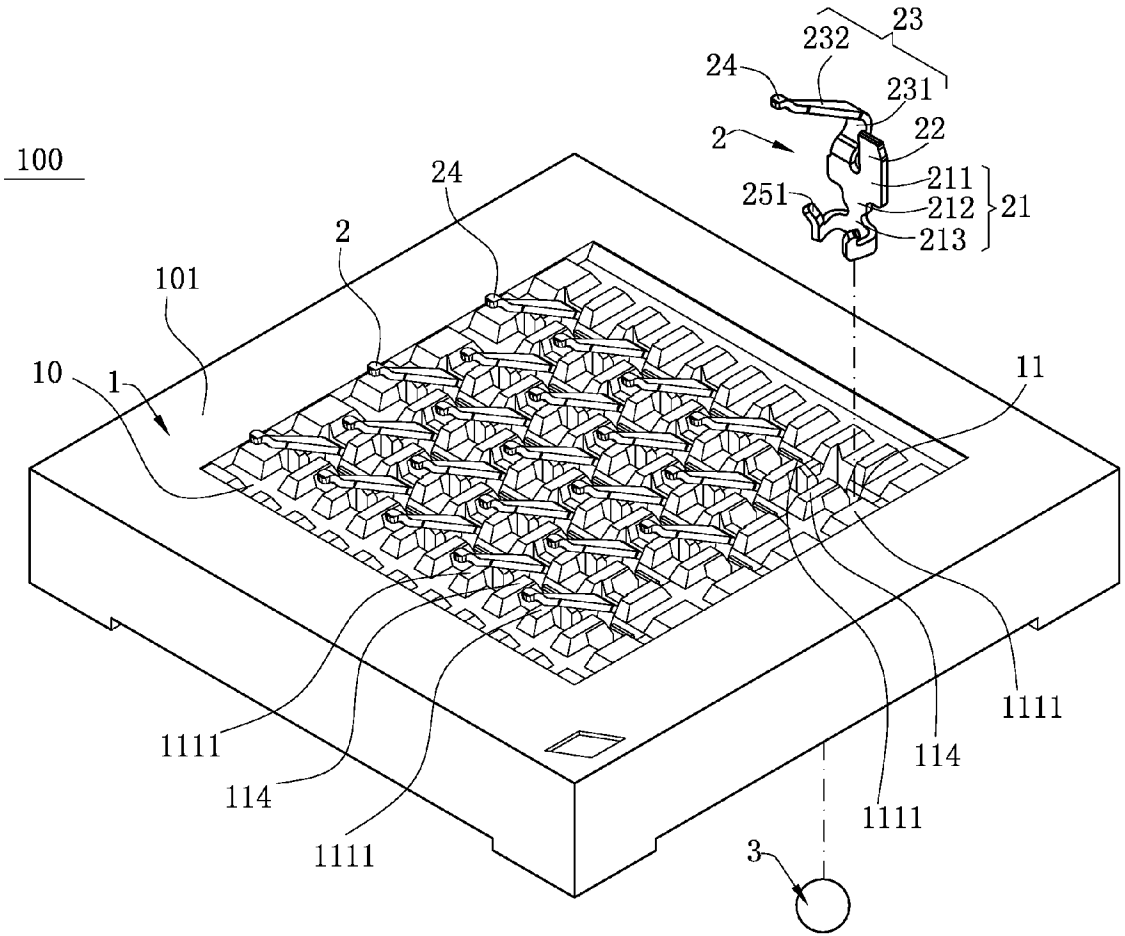
FIG. 1 is a schematic three-dimensional exploded view of an electrical connector according to one embodiment of the present invention.
Figure 2:
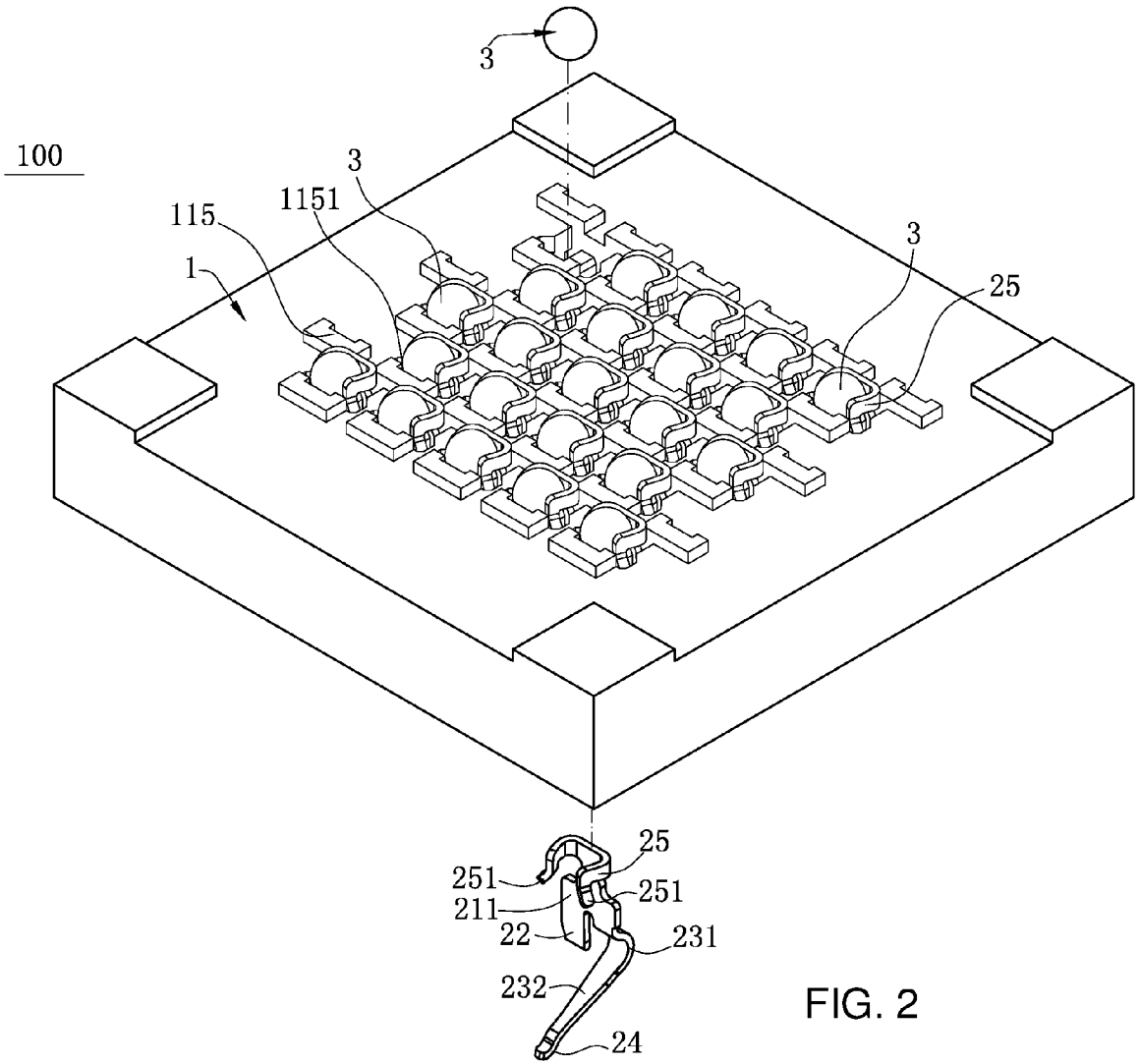
FIG. 2 is a schematic three-dimensional exploded view of the electrical connector viewing from the rear side.
Figure 3:
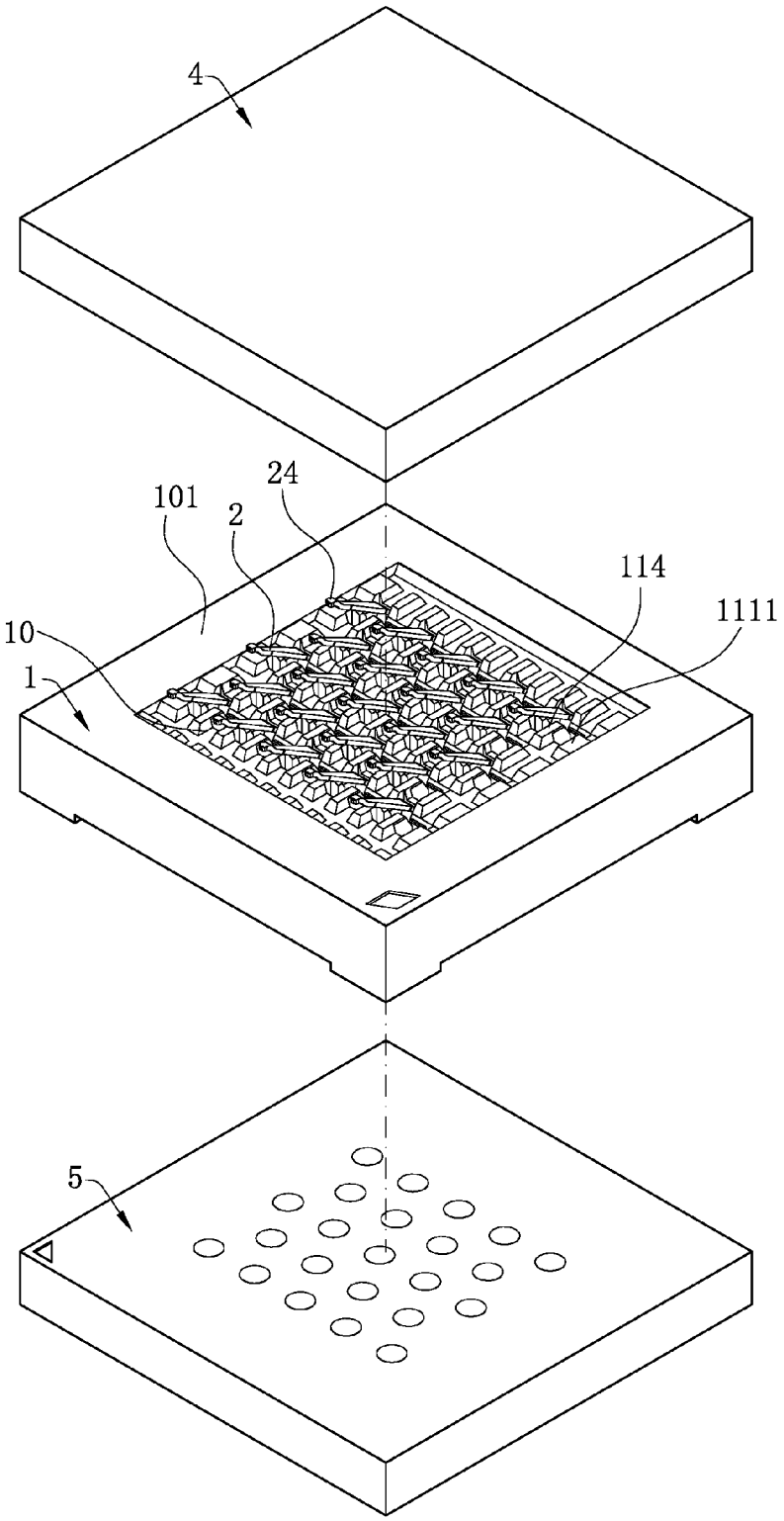
FIG. 3 is a schematic three-dimensional exploded view of the electrical connector, a chip module and a circuit board according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

As shown in FIGS. 1-5, an electrical connector 100 according to one embodiment of the present invention is a land grid array (LGA) electrical connector 100 for electrically connecting a chip module 4 to a circuit board 5. The electrical connector 100 includes an insulating body 1 and multiple terminals 2. The insulating body 1 is provided with multiple receiving slots 11 running through the insulating body 1. The terminals 2 are respectively and correspondingly inserted into the receiving slots 11 from top to bottom. Each of the terminals 2 is soldered to the circuit board 5 through a tin ball 3.

Figure 4:
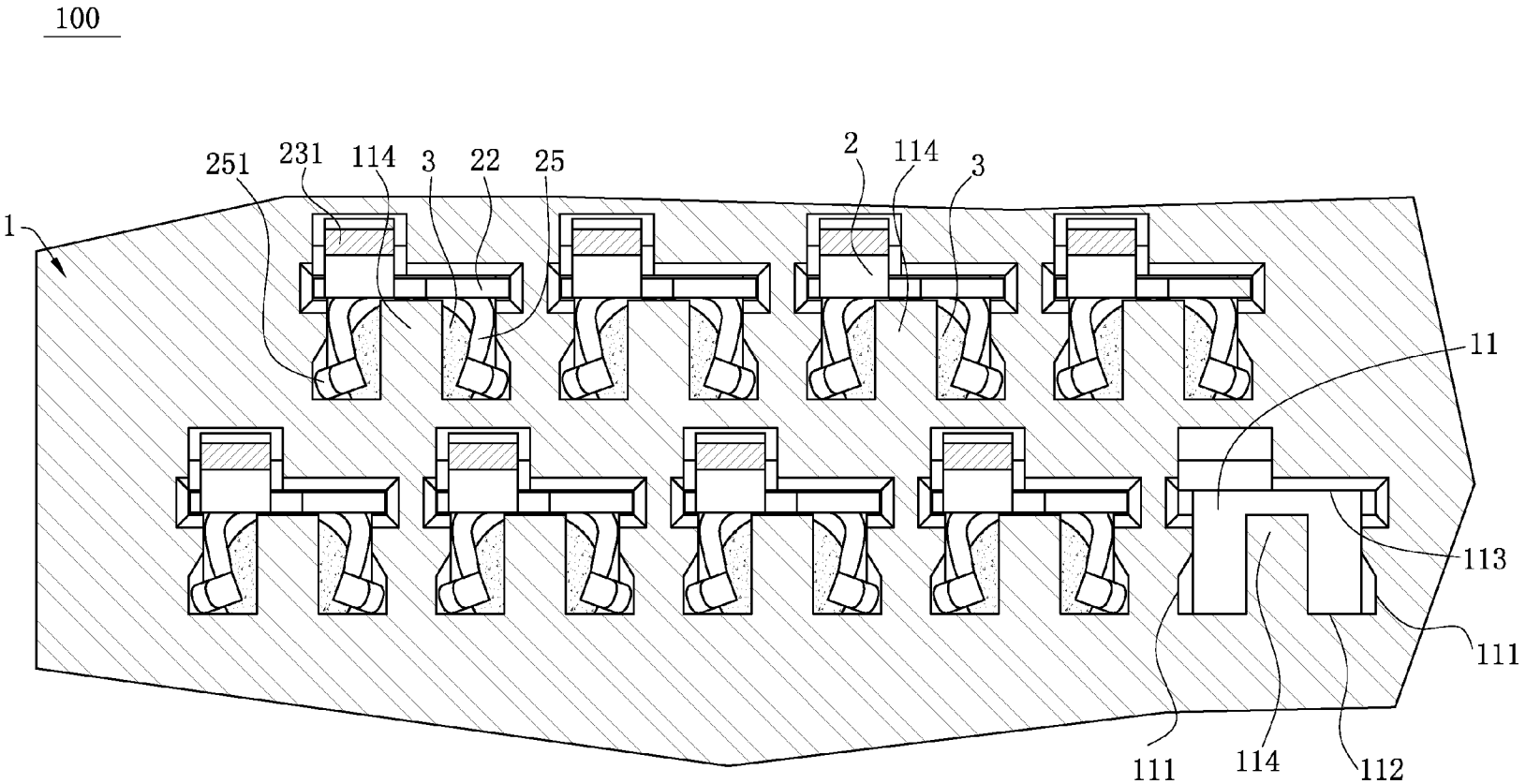
FIG. 4 is a partial sectional view of an upper surface of the electrical connector according to one embodiment of the present invention.
Figure 5:
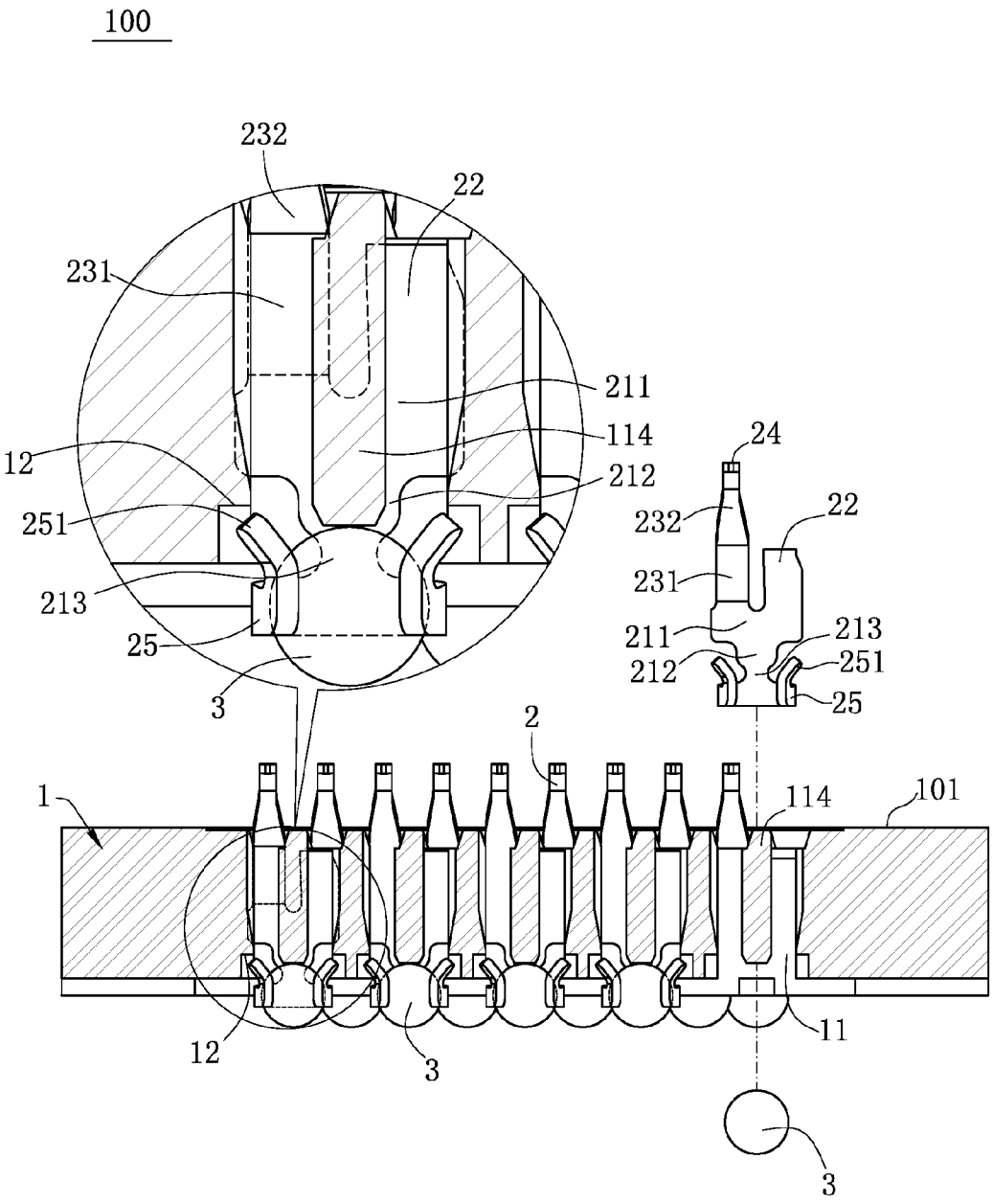
FIG. 5 is a side sectional view of the electrical connector according to one embodiment of the present invention.
Figure 6:
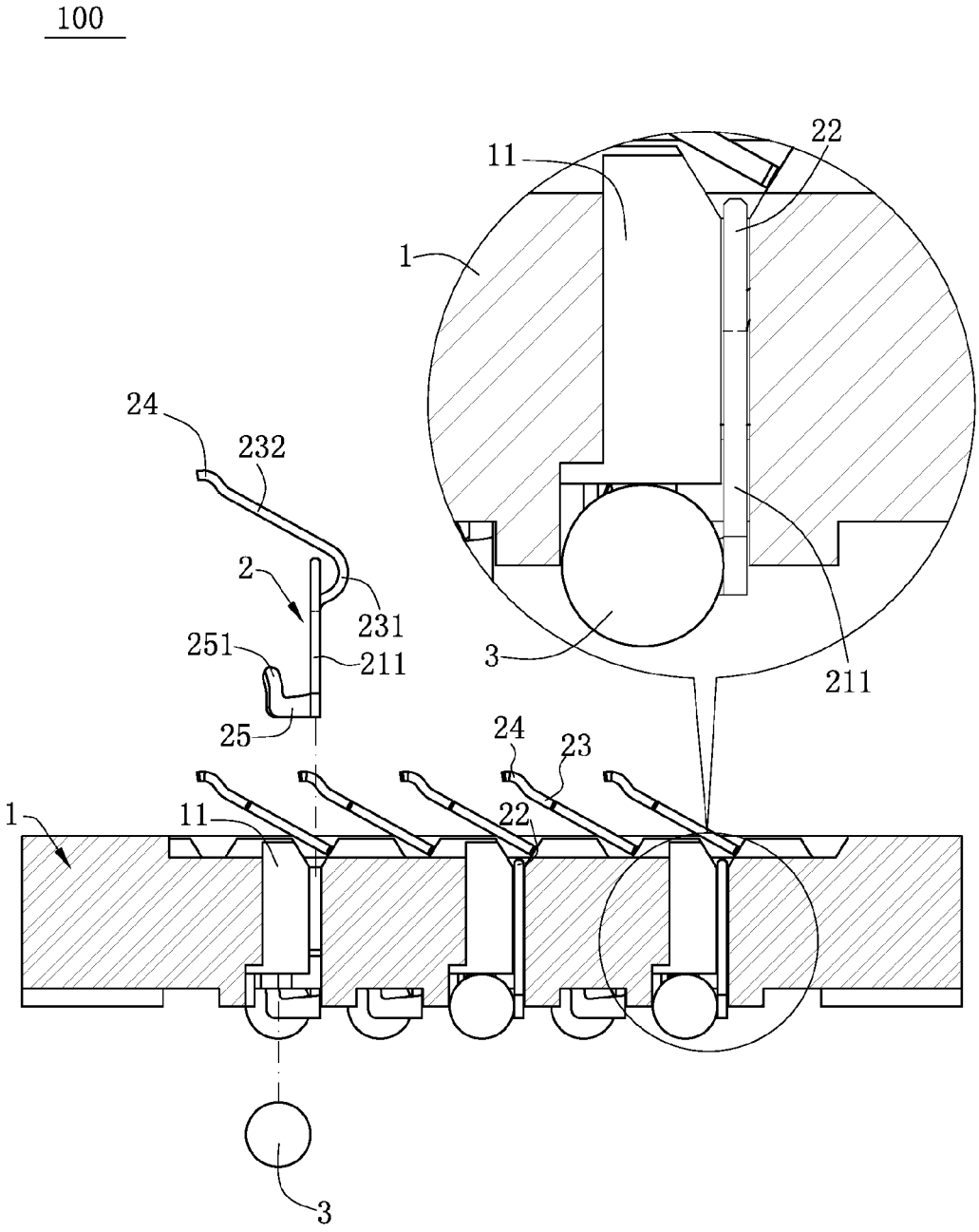
FIG. 6 is sectional view of the electrical connector from another side.

As shown in FIGS. 1, 4 and 5, the insulating body 1 has a bottom plate 10. A supporting portion 101 is disposed at the side edge of the bottom plate 10 to support the chip module 4. The receiving slots 11 run through the bottom plate 10. Each of the receiving slots 11 has two opposite first side walls 111, and a second side wall 112 and a third side wall 113 connecting the two first side wall 111 and opposite to each other. A protruding block 114 protrudes from the second side wall 112 toward the third side wall 113, and the protruding block 114 is separated from the two first side walls 111 and the third side wall 113. Further, two supporting blocks 1111 protruding upward from the two first side walls 111 are positioned at the two opposite sides of the protruding block 114, and are used to support the chip module 4. The distances between the protruding block 114 and the two opposite side walls 111 are equal, and the central line of the protruding block 114 in a vertical direction penetrates through the center of sphere of the tin ball 3, so that the situation that the tin ball 3 tilts when being assembled is avoided. The protruding block 114 extends upward to be out of the upper surface of the bottom plate 10 to support the chip module 4, and the top surface of the supporting portion 101 is higher than the top surface of the protruding block 114. A stopping block 115 protrudes from the bottom end of each of the receiving slots 11, and a groove 1151 is concavely disposed at one side of the stopping block 115 to limit the tin ball 3. A stopping surface 12 is also disposed in each of the receiving slots 11, and the stopping surface 12 is higher than the bottom surface of the protruding block 114.

As shown in FIGS. 1, 2, 5 and 6, each of the terminals 2 has a flat plate portion 21 and a material connecting portion 22 extending upward from the upper end of the flat plate portion 21. The material connecting portion 22 is used for connecting a material strip. The flat plate portion 21 and the material connecting portion 22 are positioned on the same vertical plane. The flat plate portion 21 and the material connecting portion 22 are limited between the protruding block 114 and the third side wall 113, so that the retaining forces of the terminals 2 in the receiving slots 11 are even, and thus the turnover of the terminals 2 is avoided in the process of assembling the terminals 2 into the receiving slots 11. Further, one side edge of the material connecting portion 22 is flush with one side edge of the flat plate portion 21, so as to ensure that the protruding block 114 is stopped at the middle location of the terminal 2 in the width direction.

In certain embodiments, an elastic arm 23 is formed by extending upward from the upper end of the flat plate portion 21. The elastic arm 23 has a first arm 231 and a second arm 232. The first arm 231 is formed by bending from the top end of the flat plate portion 21 and extending to a direction away from a vertical plane where the flat plate portion 21 is positioned. The second arm 232 returns, bends and extends from the first arm 231 to be beyond the vertical plane where the flat plate portion 21 is positioned. The first arm 231 and the clamping portions 25 are positioned at the two opposite sides of the vertical plane where the flat plate portion 21 is positioned. The second arm 232 is connected with a contact portion 24 which elastically urges upward the chip module 4. The two adjacent rows of terminals 2 are disposed in a staggered way, and the contact portions 24 of the rear row of terminals 2 are positioned over the corresponding material connecting portions 22 of the front row of terminals, thus facilitating the dense arrangement of the terminals 2.

The flat plate portion 21 includes a fixing portion 211 for connecting the elastic arm 23 and the material connecting portion 22, a connecting portion 212 extending downward from the fixing portion 211, an extending portion 213 extending downward from the connecting portion 212, and a clamping portion 25 bending and extending from each of the two opposite sides of the extending portion 213 along a horizontal direction. The two clamping portions 25 clamp the tin ball 3. The width of the fixing portion 211, the width of the connecting portions 212 and the width of the extending portion 213 decrease sequentially. The wider fixing portion 211 is stopped between the protruding block 114 and the second arm 232, so as to ensure the retaining force of the terminal 2. The narrower extending portion 213 is connected with the clamping portions 25, so as to increase the upward elasticity of the terminal 2 during installation of the tin bass 3 in the clamping portions 25, and reduce the risk of deformation and dislocation of the terminal 2 by the urging of the tin ball 3. A stopping portion 251 is formed by extending upward from each of the tail ends of the two clamping portions 25 and bending in an opposite direction and is stopped at the stopping surface 12, so as to prevent deformation of the clamping portions 25 by the urging of the tin ball 3 and preventing the upward dislocation of the terminal 2. The height of the top end of the stopping portion 251 is between the upper edge and the lower edge of the connecting portion 212, so as to enhance the stopping effect of the stopping portion 251.

In summary, the electrical connector 100 according to one embodiment of the present invention has the following beneficial advantages.

(1) The flat plate portion 21 and the material connecting portion 22 are limited between the protruding block 114 and the third side wall 113, so that the limiting forces of the terminals 2 are even, and thus the turnover in assembly is avoided, the assembly difficulty of products is reduced, and the yield of the products is improved.

(2) The tin ball 3 is positioned below the protruding block 114 so as to limit the upward movement of the tin ball 3, so that the arrangement that a C-shaped bending arm formed by bending the flat plate portion 21 stops the tin ball 3 is omitted, the structure of the terminals 2 is simplified, the assembly difficulty of the electrical connector 100 is reduced, and the market competitiveness of the products is improved.

(3) The width of the fixing portion 211, the width of the connecting portions 212 and the width of the extending portion 213 decrease sequentially. The wider fixing portion 211 is stopped between the protruding block 114 and the second arm 232, so as to ensure the retaining force of the terminal 2. The narrower extending portion 213 is connected with the clamping portions 25 so as to increase the upward elasticity of the terminal 2 during installation of the tin ball 3 in the clamping portions 25, and reduce the risk of deformation and dislocation of the terminal 2 by the urging of the tin ball 3.

(4) The stopping portion 251 is stopped at the stopping surface 12, so as to avoid deformation of the clamping portions 25 by upward urging of the tin ball 3, and to prevent upward dislocation of the terminal 2.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for conducting a chip module to a circuit board, comprising:

an insulating body, wherein the insulating body has a bottom plate, a plurality of receiving slots are disposed in the bottom plate, each of the receiving slots has two opposite first side walls, and a second side wall and a third side wall connected with the two first side walls and opposite to each other, a protruding block protrudes from the second side wall toward the third side wall, and the protruding block is separated from the two first side walls and the third side wall;

a plurality of terminals correspondingly received in the receiving slots, wherein each of the terminals has a flat plate portion, an elastic arm and a material connecting portion extending upward from the flat plate portion, a contact portion formed at a top end of the elastic arm to upward and elastically urge against the chip module, and two clamping portions bending and extending from the two opposite sides of the flat plate portion along a horizontal direction, and the flat plate portion and the material connecting portion are limited between the protruding block and the third side wall; and a plurality of tin balls respectively and correspondingly fixed between the two clamping portions of corresponding one of the terminals, and soldered to the circuit board, wherein the tin balls are positioned below the protruding block and are prevented from moving upward.

2. The electrical connector of claim 1, wherein each of the protruding blocks extends upward and exposes from an upper surface of the insulating body, and is used for supporting the chip module.

3. The electrical connector of claim 2, wherein a supporting portion is disposed at a side edge of the bottom plate to support the chip module, and a top surface of the supporting portion is higher than top surfaces of the protruding blocks.

4. The electrical connector of claim 2, wherein two supporting blocks protruding upward from the two first side walls of each of the receiving slots are positioned at two opposite sides of corresponding one of the protruding blocks, and are used for supporting the chip module.

5. The electrical connector of claim 1, wherein two adjacent rows of the terminals are staggered, and the elastic arms of a rear row of the two adjacent rows of the terminals extend beyond a part over the material connecting portions of a front row of the two adjacent rows of the terminals.

6. The electrical connector of claim 1, wherein a stopping block protrudes from the bottom end of each of the receiving slots, a groove is concavely disposed at one side of the stopping block to limit corresponding one of the tin balls, and the other opposite side of the stopping block stops the two clamping portions of corresponding two adjacent terminals.

7. The electrical connector of claim 1, wherein the flat plate portion comprises a fixing portion for connecting the elastic arm and the material connecting portion, a connecting portion extending downward from the fixing portion, an extending portion extending downward from the connecting portion, and the clamping portions extending from two opposite sides of the extending portion, and wherein a width of the fixing portion, a width of the connecting portion and a width of the extending portion decrease sequentially.

8. The electrical connector of claim 7, wherein each of the receiving slots is provided with two stopping surfaces, two stopping portions are formed by extending upward from ends of the two clamping portions of corresponding one of the terminals and bending to opposite directions, and are stopped at the two stopping surfaces, and a height of a top end of each of the stopping portions is between an upper edge and a lower edge of the connecting portion.

9. The electrical connector of claim 1, wherein each of the receiving slots is provided with two stopping surfaces, two stopping portions are formed by extending upward from ends of the two clamping portions of corresponding one of the terminals and bending to opposite directions, and are stopped at two stopping surfaces, each of the two stopping surfaces is higher than the bottom surface of the protruding block.

10. The electrical connector of claim 1, wherein the elastic arm of each of the terminals comprises a first arm bending from a top end of the flat plate portion and extending to a direction away from a vertical plane where the flat plate portion is positioned, and a second arm which returns, bends and extends from the first arm and is beyond the vertical plane where the flat plate portion is positioned, the first arm and the clamping portions are positioned at the two opposite sides of the vertical plane where the flat plate portion is positioned, and the second arm is connected with the contact portion.

* * * * *